US005341885A

United States Patent [19]

Bridges

[11] Patent Number: 5,341,885

[45] Date of Patent: Aug. 30, 1994

[54] INTERNAL TUBING HANGER LOCKDOWN

[75] Inventor: Charles D. Bridges, Cypress, Tex.

[73] Assignee: ABB Vetco Gray Inc., Houston, Tex.

[21] Appl. No.: 127,217

[22] Filed: Sep. 27, 1993

[51] Int. Cl.[5] ..... E21B 23/02

[52] U.S. Cl. ..... 166/382; 166/75.1; 166/208

[58] Field of Search ..... 166/382, 348, 75.1, 166/208, 85

[56] References Cited

U.S. PATENT DOCUMENTS

| | | | |
|---|---|---|---|
| 3,603,401 | 9/1971 | Nelson | 166/89 X |
| 3,924,678 | 12/1975 | Ahlstone . | |
| 4,465,134 | 8/1984 | Watkins | 166/245 |
| 4,540,053 | 9/1985 | Baugh et al. | 166/348 |
| 4,561,499 | 12/1985 | Berner, Jr. et al. | 166/85 |
| 4,597,448 | 7/1986 | Baugh | 166/348 |
| 4,615,544 | 10/1986 | Baugh | 166/348 X |
| 4,651,831 | 3/1987 | Baugh | 166/344 |
| 4,880,061 | 11/1989 | Ahlstone | 166/348 |

*Primary Examiner*—Ramon S. Britts
*Assistant Examiner*—Frank S. Tsay
*Attorney, Agent, or Firm*—James E. Bradley

[57] ABSTRACT

An internal lockdown will lock a tubing hanger in a wellhead housing. The tubing hanger has a conical cam surface formed on the exterior. An internal profile is located in the bore of the housing in alignment with the cam surface. A landing sub secures to a threaded bore of the tubing hanger and protrudes above. A carrier ring mounts to exterior threads formed on the landing sub. The carrier ring carries a set of segmented dogs. After the tubing hanger lands, the landing sub is unscrewed relative to the tubing hanger and carrier ring assembly. Then, the landing sub is lowered, pushing the dogs out into engagement with the profile.

19 Claims, 5 Drawing Sheets

INTERNAL TUBING HANGER LOCKDOWN

BACKGROUND OF THE INVENTION

1. Field of the Invention

This invention relates in general to wellhead assemblies, and in particular to an apparatus for locking a tubing hanger within a wellhead housing.

2. Description of the Prior Art

In oil and gas wells where the wellhead is located at the surface, a tubing hanger will land within a wellhead housing. The tubing hanger is located at the upper end of one or more strings of tubing through which production fluids will pass. The tubing hanger is sealed and locked to the wellhead housing.

The most typical type of lockdown utilizes threaded rods which extend radially inward in the wellhead housing. Each threaded rod or stud extends through a threaded hole in the wellhead housing. The inner end of each rod is conical for engaging a conical shoulder on the tubing hanger. There are several threaded rods used in each installation. The operator installs the threaded rods by using a wrench to rotate them.

While workable, the threaded rods require that holes be drilled and threaded through the wellhead housing. The rods add to the expense of the lockdown considerably.

SUMMARY OF THE INVENTION

An internal lockdown is utilized to hold the tubing hanger in place, rather than radially extending threaded rods. The internal lockdown includes a plurality of dogs that move from a retracted position to an extended position. In the extended position, the dogs will engage an annular profile located in the wellhead housing. The dogs are carried by a carrier ring. The carrier ring is carried on a landing sub. The landing sub inserts into the bore of the tubing hanger and engages the tubing hanger for lowering the tubing hanger into the bore of the wellhead housing.

A retainer ring supports the carrier ring on the landing sub in an upper position as the tubing hanger is lowered into the well. The retainer ring then moves the carrier ring and the dogs to a lower position into the profile of the housing after the tubing hanger has landed in the bore of the housing.

In the preferred embodiment, the retainer ring is internally threaded for engaging threads on the landing sub. The retainer ring is temporarily fastened to the carrier ring by temporary fasteners. After the tubing hanger has landed, unscrewing the landing sub while holding the retainer ring stationary will cause the landing sub to move upward relative to the retainer ring. Then, lowering the landing sub back downward will push the carrier ring downward, forcing the dogs out into the profile.

DETAILED DESCRIPTION OF THE INVENTION

Figure 1:
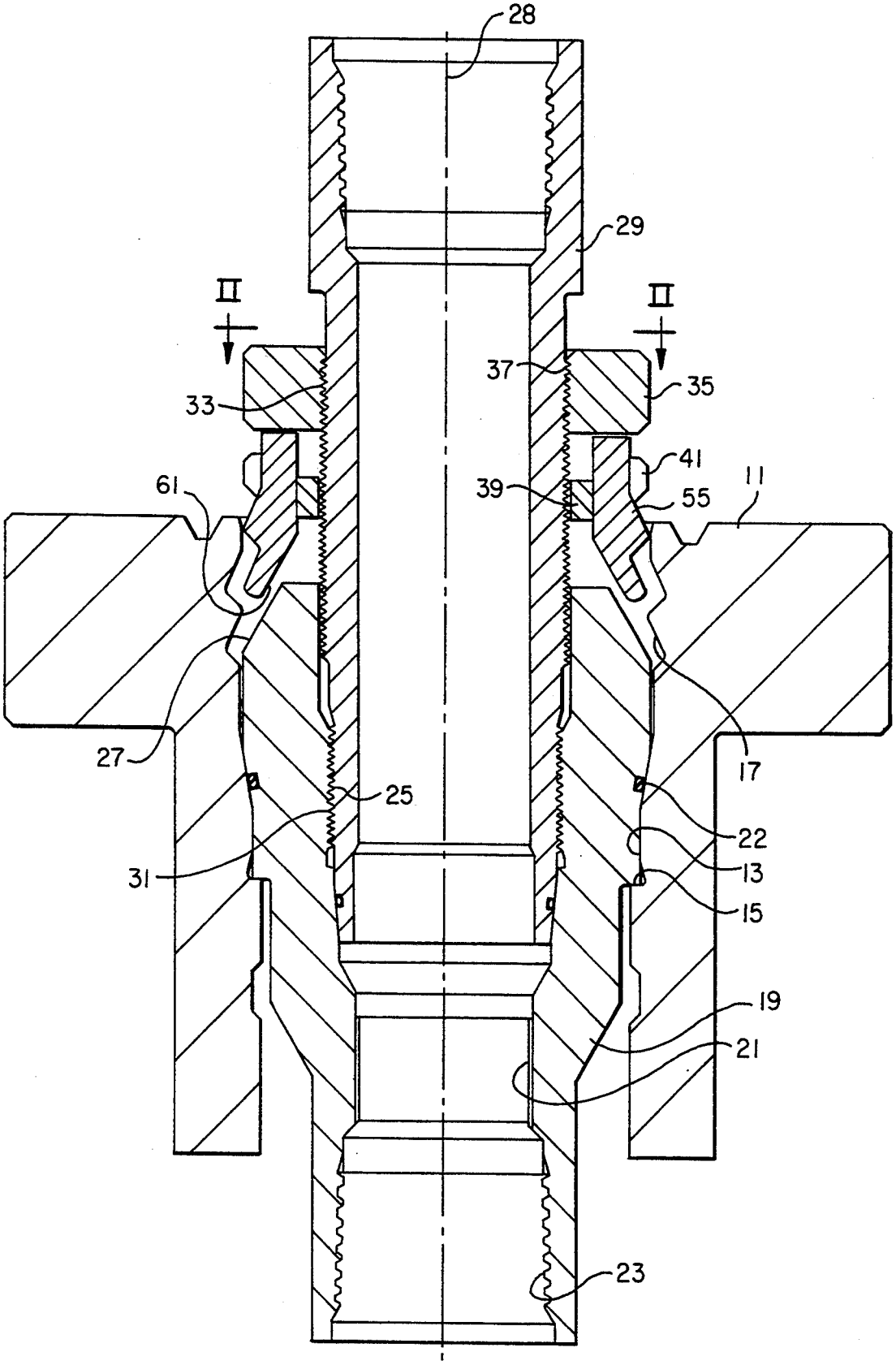
FIG. 1 is a vertical sectional view taken along the line I—I of FIG. 2, and showing a wellhead having a lockdown assembly constructed in accordance with this invention, with the dogs in a retracted position.

Referring to FIG. 1, wellhead housing 11 is a tubular member that will be located at the surface and secured to casing extending into the well. An axial bore 13 extends through wellhead housing 11. A landing shoulder 15 faces upward in bore 13. A profile 17 is located in bore 13 near the upper end of wellhead housing 11. Profile 17 is an annular recess or groove comprising a pair of conical downward and inward facing surfaces.

A tubing hanger 19 will land in wellhead housing 11 on landing shoulder 15. Tubing hanger 19 has either one axial bore 21 as shown, or it may have two side-by-side axial bores (not shown). Tubing hanger 19 seals in bore 13 with metal-to-metal sealing and optionally an elastomeric seal 22. A threaded connector 23 at the lower end of tubing hanger 19 secures to a string of tubing (not shown) that extends into the well. The tubing is conventional and will normally be sealed by a packer at the lower end to the casing for producing well fluids through the tubing.

Tubing hanger 19 also has a set of internal threads 25 located in bore 21 intermediate the upper and lower ends. In addition, a cam surface 27 is located on the upper end of tubing hanger 19. Cam surface 27 is conical and faces outward and upward. Cam surface 27 is spaced inward from profile 17 once tubing hanger 19 has landed, defining an annular slot. In the preferred embodiment, conical surface 27 has a slightly different angle of taper than profile 17. The angle of intersection between longitudinal axis 28 and cam surface 27 is slightly greater than the angle that profile 17 intersects axis 28. This difference is approximately five degrees in the preferred embodiment.

A landing sub 29 is used to lower the tubing hanger 19 and the string of tubing (not shown) into wellhead housing 11. Landing sub 29 is a tubular member having a lower end with threads 31 that engage tubing hanger internal threads 25. Landing sub 29 also has a set of upper threads 33. In the embodiment shown, upper threads 33 are of a diameter slightly greater than lower threads 31. Upper threads 33 protrude above the upper end of wellhead housing 11.

Figure 12:
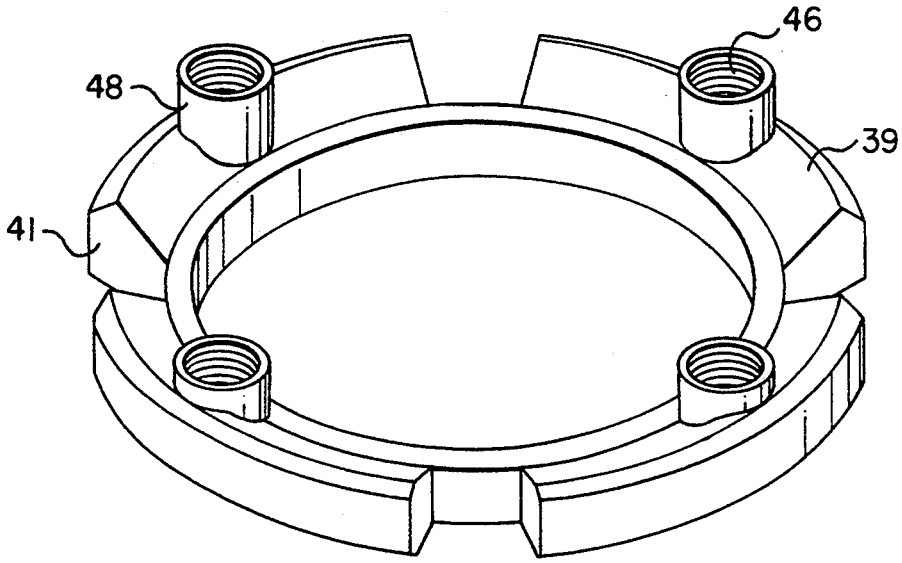
FIG. 12 is a perspective view of the carrier ring used with the lockdown assembly of FIG. 1.

The lockdown assembly includes a retainer means or retainer ring 35 which has internal threads 37. Internal threads 37 engage landing sub upper external threads 33. Retainer ring 35 retains and is temporarily secured to a carrier ring 39. Carrier ring 39, shown also in FIG. 12, is a solid annular ring. Carrier ring 39 does not have internal threads and is of slightly greater diameter than the diameter of the landing sub threads 33. Carrier ring 39 has four radially extending slots 41 circumferentially spaced around its perimeter. Slots 41 extend from the outer edge inward a selected distance.

Figure 2:
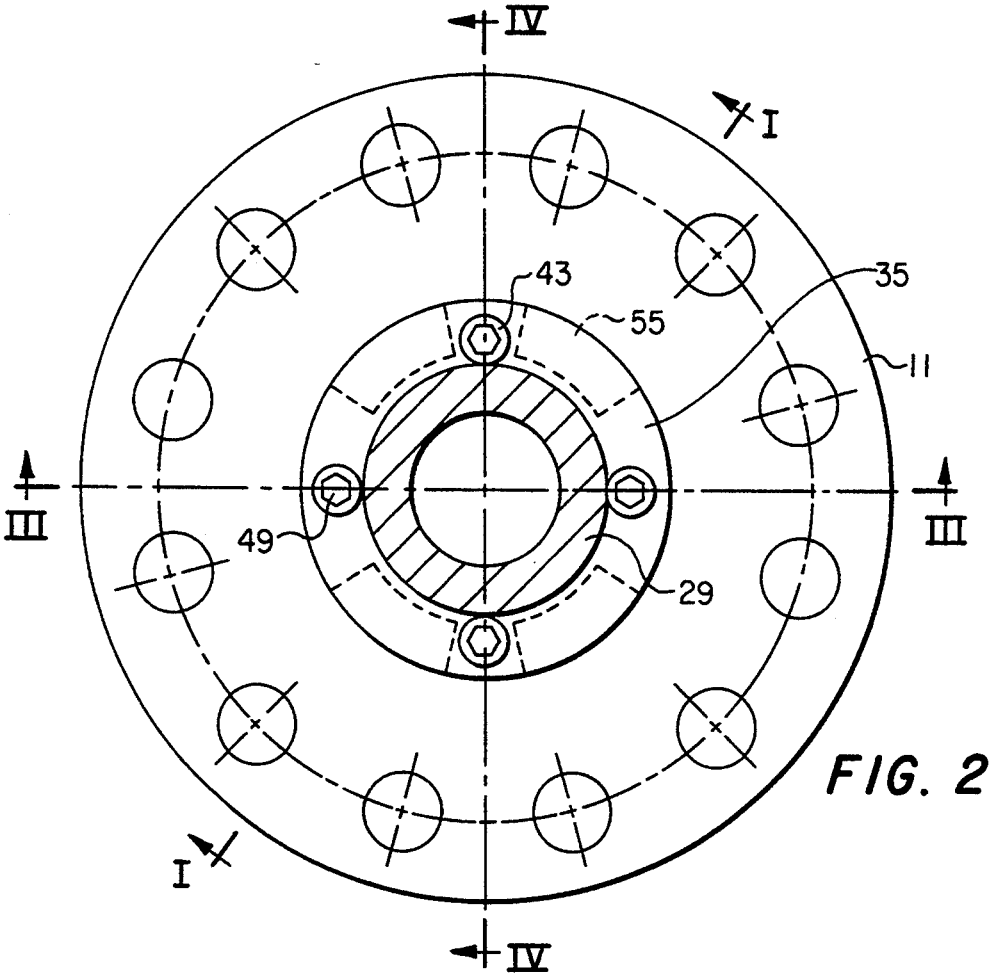
FIG. 2 is a sectional view of the wellhead assembly of FIG. 1 taken along the line II—II of FIG. 1.
Figure 4:
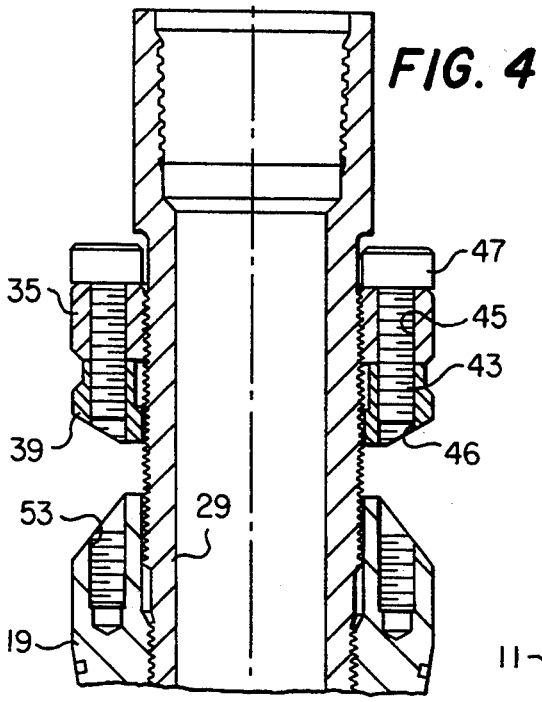
FIG. 4 is a partial sectional view of the lockdown assembly for the wellhead of FIG. 1, taken along the line IV—IV of FIG. 2.

Referring to FIG. 4, two temporary fasteners 43 are used to secure retainer ring 35 to carrier ring 39. The temporary fasteners 43 are bolts spaced 180 degrees apart from each other, as shown in FIG. 2. The temporary fasteners 43 extend through smooth bore holes 45 in retainer ring 35 and screw into threaded holes 46 in carrier ring 39. The heads 47 of the fasteners 43 are larger in diameter than the retainer holes 45 to secure carrier ring 39 to the lower side of retainer ring 35. As shown in FIG. 12, the threaded holes 46 in carrier ring 39 are preferably located on tubular sockets 48 which are integrally formed with carrier ring 39. Also, the upper surface of carrier ring 39 is conical and concave.

Figure 3:
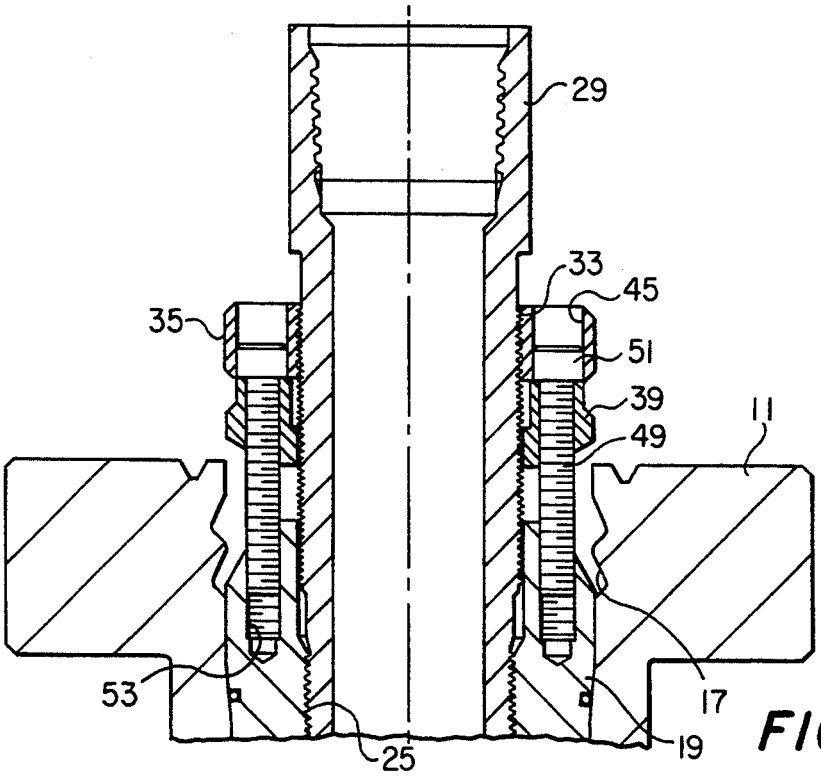
FIG. 3 is a partial sectional view of the wellhead assembly of FIG. 1, taken along the line III—III of FIG. 2.

Referring now to FIG. 3, two permanent fasteners or bolts 49 extend through the threaded holes 46 without engaging the threads, and thus are smaller in diameter than temporary fasteners 43. Each permanent fastener 49 has a head 51 that is of smaller diameter than the retainer ring holes 45. Head 51, however, is greater in diameter than the carrier ring threaded holes 46. Permanent fasteners 49 are bolts spaced 180 degrees apart from each other and alternating with temporary fasteners 43, as shown in FIG. 2. Permanent fasteners 49 are longer than temporary fasteners 43 and extend into threaded holes 53 formed in the upper end of tubing hanger 19. Note that the lower ends of the permanent fasteners 49 are spaced at an initial upper position at least one inch or so above the base of each threaded hole 53.

Figure 5:
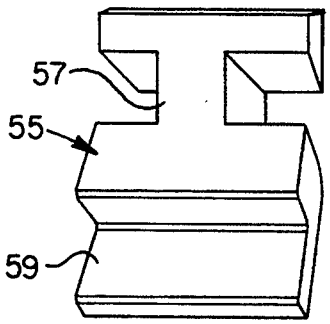
FIG. 5 is an isometric view of one of the dogs of the lockdown assembly of FIG. 1.

Referring again to FIG. 1, four dogs 55 are carried by carrier ring 39, one in each slot 41. Each dog 55 has a neck 57, as shown in FIG. 5, that inserts slidingly into one of the slots 41. The upper portion of each dog 55 above neck 57 locates on the upper surface of carrier ring 39 to retain each dog 55. Dogs 55 are slidable inward and outward between retracted and engaged positions relative to carrier ring 39. Each dog 55 has an external conical surface 59 which slidingly engages and is at the same taper as profile 17. Each dog 55 has an internal conical surface 61 that will slidingly engage and is at the same taper as tubing hanger cam surface 27. The angles of taper of the external and internal conical surfaces 59, 61 differ by five degrees so that each will mate with its respective surface 17, 27. The five degree difference in taper creates a locking or wedging action to prevent the dogs 55 from working back upward when they are in the engaged position with profile 17.

In operation, wellhead housing 11 will be located at the surface at the upper end of the well. Casing will be located in the well and the tubing will be lowered into well and initially supported by slips at the rig floor. The operator will make up the assembly shown in FIG. 1, securing retainer ring 35 to carrier ring 39 by means of temporary fasteners 43 (FIG. 4). Retainer ring 35 will prevent dogs 55 from sliding off of the slots 41. Retainer ring 35 is secured to the landing sub threads 33. Two permanent fasteners 49 will be secured in threaded holes 53 at an initial upper position above the bottoms of holes 53. The operator secures the connector 23 to the upper end of the string of tubing. The operator secures landing sub 29 to another section of conduit which is supported by the rig.

The operator then lowers the entire assembly as shown in FIG. 1 into wellhead housing 11. Tubing hanger 19 will land on shoulder 15. The exterior of tubing hanger 19 forms a metal-to-metal seal in the embodiment shown, along with elastomeric seal 22. Dogs 55 will be in the upper position, spaced from profile 17. Conical cam surface 27 will be spaced radially inward and aligned with the lowermost conical surface of profile 17.

Figure 7:
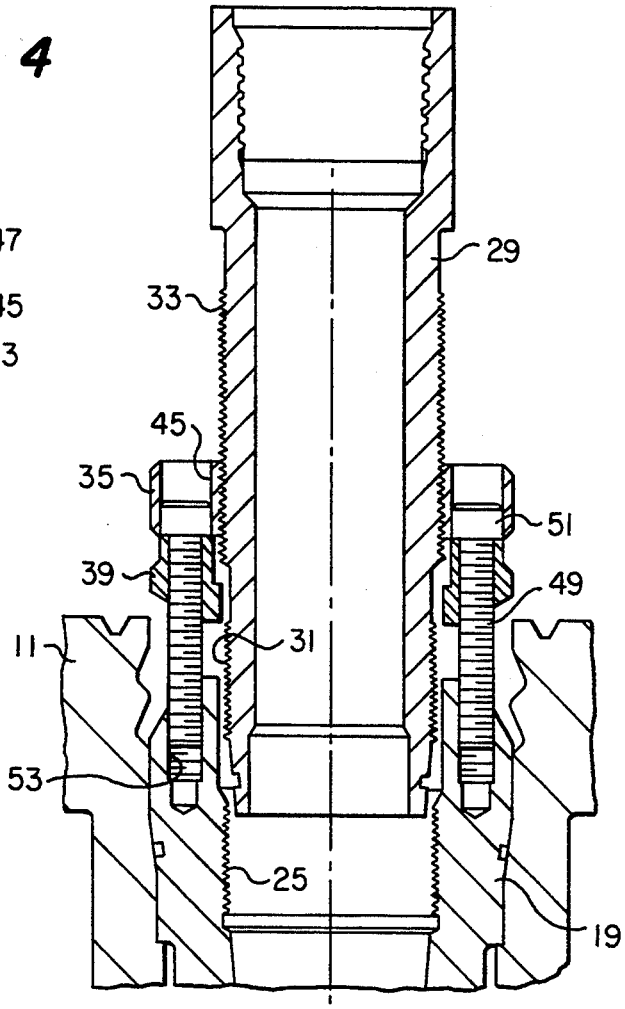
FIG. 7 is a sectional view of the lockdown assembly taken the same section line as FIG. 3, and showing the landing sub in the upper position of FIG. 6.
Figure 6:
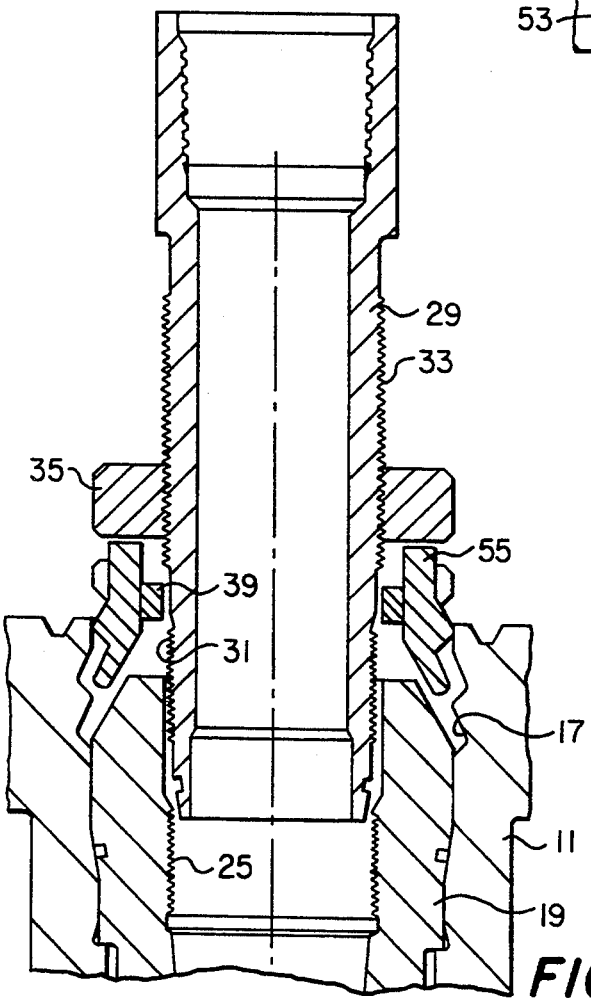
FIG. 6 is a sectional view of the lockdown assembly of FIG. 1, taken along the same section line as FIG. 1 and showing the landing sub moved to an upper position.

The operator will rotate the landing sub 29 to unscrew it from the tubing hanger threads 31. The permanent fasteners 49 (FIG. 3) prevent the retainer ring 35, carrier ring 39, and dogs 55 from rotating. Landing sub 29 will thus move upward to an upper position relative to carrier ring 39, as shown in FIG. 6. In this position, the lower end of landing sub 29 will be spaced slightly above the tubing hanger threads 25. Referring to FIG. 7, note that the permanent fasteners 49 remain in the same position relative to tubing hanger 19 as well as carrier ring 39.

Figure 8:
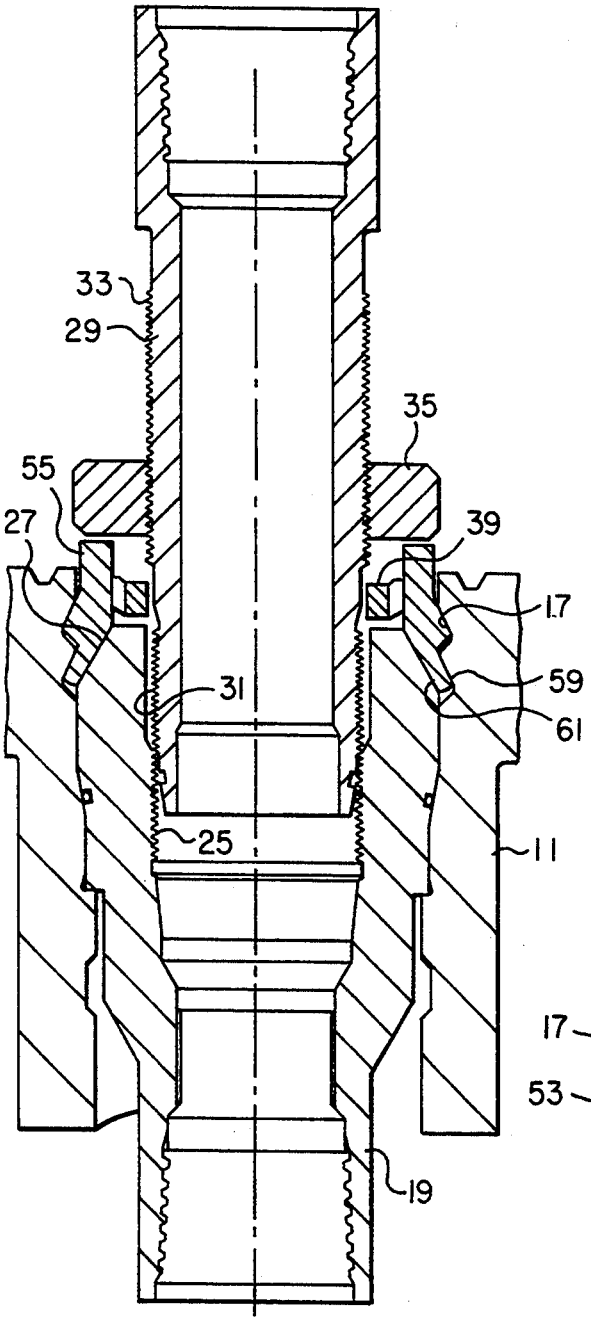
FIG. 8 is a sectional view of the lockdown assembly taken along the same sectional line as FIG. 1, and showing the landing sub moved back to a lower position, with the dogs engaged with the wellhead housing profile.
Figure 9:
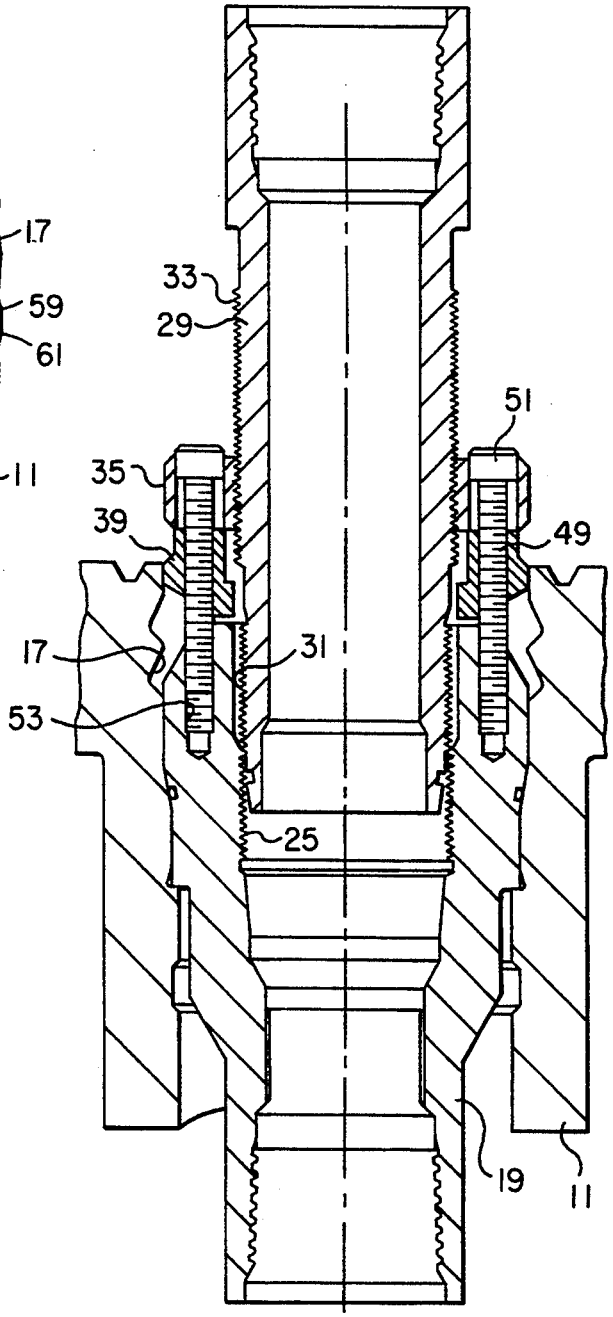
FIG. 9 is a sectional view of the lockdown assembly taken along the same section line as FIG. 3, and showing the landing sub moved to the lower position as in FIG. 8.

The operator will then slack off weight in the conduit located above landing sub 29 to cause it to move downward about one inch or so from the position shown in FIGS. 6 and 7. As landing sub 29 moves downward, retainer ring 35 will force carrier ring 39 downward. The dogs 55 will engage cam surface 27 and slide downward and outward to an engaged position as shown in FIG. 8, with the external conical surface 59 mating with profile 17, and the internal conical surface 61 mating with tubing hanger cam surface 27. Note that the permanent fasteners 49 remain stationary, therefore the heads 51 will now be protruding slightly above the upper surface of retainer ring 35.

Figure 10:
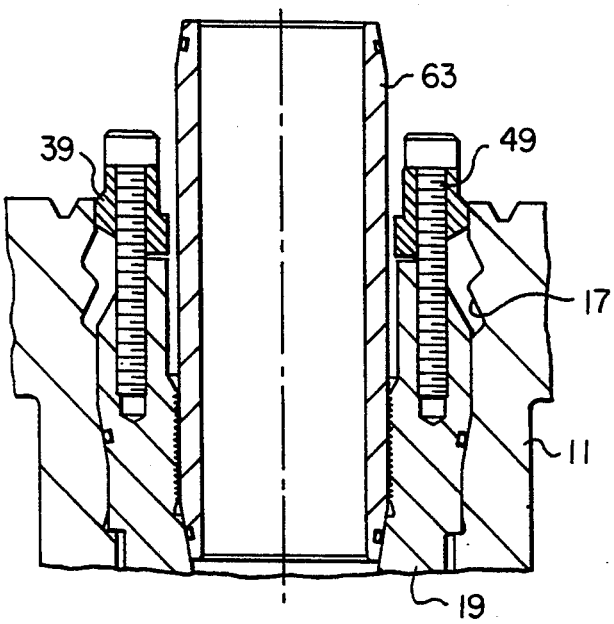
FIG. 10 is a sectional view of the lockdown assembly taken along the same section line as FIG. 1, and showing the retainer ring and landing sub removed and with a seal sub in place.
Figure 11:
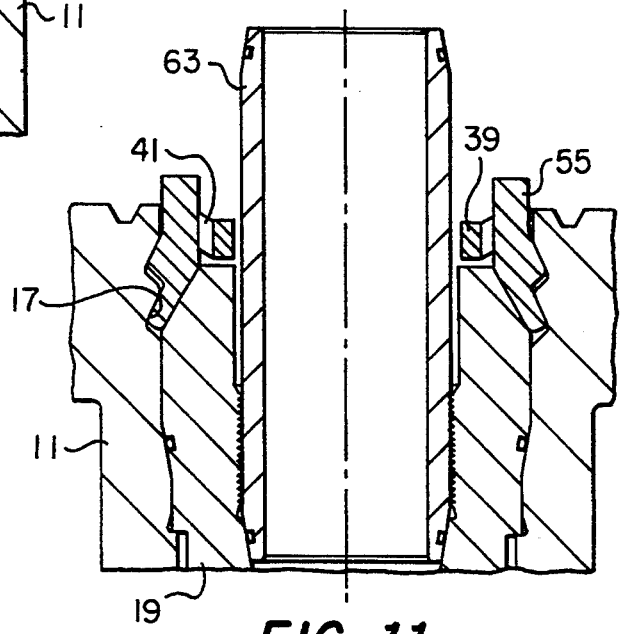
FIG. 11 is a sectional view of the lockdown assembly, taken along the same section line as FIG. 3, and showing the retainer ring and landing sub removed and with a seal sub in place as in FIG. 10.

The two permanent fasteners 49 may then be screwed down to the lower position shown in FIG. 10. The lower ends will have moved closer toward the bases of the threaded holes 53 in the tubing hanger. The heads 51 will bear against the carrier ring 39 to tightly secure carrier ring 39 in the lower position. The two temporary fasteners 43 (FIG. 4) are removed. These are replaced with two permanent fasteners 49 which are bolts of the same size and configuration as the permanent fasteners 49 previously discussed. The four permanent fasteners 49 do not engage the threads 46 (FIG. 4) in the carrier ring 39, rather engage only the threads 53 in the tubing hanger 19 to hold the carrier ring 39 in the lower position. FIG. 11 shows the configuration with the retainer ring 35 removed and the dogs 55 locked in place.

The landing sub 29 will be removed and replaced by a conventional seal nipple 63 as shown in FIGS. 10 and 11. A head or bonnet (not shown) will then be placed over wellhead housing 11 and secured by bolts to the flange of wellhead housing 11 in a conventional manner.

The invention has significant advantages. Threaded holes are not required to be placed through the wellhead housing. High strength threaded studs are not required. The internal lockdown is less expensive than the prior art type.

While the invention has been shown in only one of its forms, it should be apparent to those skilled in the art that it is not so limited, but is susceptible to various changes without departing from the scope of the invention.

I claim:

1. In a wellhead assembly having a housing which has an axial bore, a tubing hanger which secures to a string of tubing, has an axially extending bore, and which lands in the bore of the housing, the improvement comprising:

a conical cam surface formed on an upper exterior portion of the tubing hanger;

an internal profile formed in the bore of the housing in a position which aligns with the cam surface when the tubing hanger has landed in the bore of the housing;

a set of segmented dogs having exterior surfaces for engaging the profile in the housing;

a carrier ring which carries the dogs;

a landing sub which releasably inserts into the bore of the tubing hanger and engages the tubing hanger for lowering the tubing hanger into the bore of the wellhead housing; and retainer means for supporting the carrier ring on the landing sub in an upper position relative to the cam surface as the tubing hanger is lowered into the well, and for moving the carrier ring and the dogs to a lower position with the dogs moving into the profile of the housing after the tubing hanger has landed in the bore of the housing.

2. The wellhead assembly according to claim 1 wherein:

the landing sub has a set of exterior upper threads; and the retainer means comprises a set of retainer threads, allowing relative axial movement of the landing sub and carrier ring by rotation of the landing sub and carrier ring relative to each other, to move the carrier ring from the upper to the lower position.

3. The wellhead assembly according to claim 1 wherein:

the landing sub has a set of exterior upper threads; and the retainer means comprises a threaded retainer ring which engages the upper threads and engages the carrier ring, such that relative axial movement of the landing sub and retainer ring occurs by rotation of the landing sub and retainer ring relative to each other, moving the carrier ring from the upper to the lower position.

4. The wellhead assembly according to claim 1 wherein:

the bore of the tubing hanger has a set of threads;

the landing sub has a set of exterior lower threads which releasably engage the threads of the bore of the tubing hanger and a set of exterior upper threads; and the retainer means comprises a set of retainer threads which engage the upper threads, whereby the carrier ring will remain a fixed axial distance from the profile while the landing sub is unscrewed from the threads in the bore in the tubing hanger, thereby moving the landing sub upward relative to the carrier ring, so that subsequent downward movement of the landing sub moves the carrier ring from the upper to the lower position.

5. The wellhead assembly according to claim 1 wherein: the bore of the tubing hanger has a set of threads;

the landing sub has a set of exterior lower threads which releasably engage the threads of the bore of the tubing hanger and a set of exterior upper threads; and the retainer means comprises a threaded retainer ring which engages the upper threads and is releasably secured to the carrier ring, allowing the retainer ring to remain a fixed axial distance from the profile while the landing sub is unscrewed from the threads in the bore in the tubing hanger, thereby moving the landing sub upward relative to the carrier ring, so that subsequent downward movement of the landing sub moves the carrier ring from the upper to the lower position.

6. The wellhead assembly according to claim 1, further comprising:

a plurality of fasteners which secure to axially extending threaded holes in the tubing hanger and through holes provided in the carrier ring to hold the carrier ring in the lower position once it has moved to the lower position.

7. The wellhead assembly according to claim 1 wherein:

the landing sub has a set of exterior upper threads;

the retainer means comprises a set of retainer threads, allowing relative axial movement of the landing sub and carrier ring by rotation of the landing sub and retainer threads relative to each other, to move the carrier ring from the upper to the lower position; and further comprising:

a plurality of fasteners which secure to axially extending threaded holes in the tubing hanger and through holes provided in the carrier ring to hold the carrier ring in the lower position once it has moved to the lower position.

8. The wellhead assembly according to claim 1 wherein:

the bore of the tubing hanger has a set of threads;

the landing sub has a set of exterior lower threads which releasably engage the threads of the bore of the tubing hanger and a set of exterior upper threads;

the retainer means comprises a threaded retainer ring which engages the upper threads and secures to the carrier ring, allowing the retainer ring to remain a fixed axial distance from the profile while the landing sub is unscrewed from the threads in the bore in the tubing hanger, thereby moving the landing sub upward relative to the carrier ring, so that subsequent downward movement of the landing sub moves the carrier ring from the upper to the lower position; and a plurality of fasteners which secure to axially extending threaded holes in the tubing hanger and through holes provided in the carrier ring to hold the carrier ring in the lower position once it has moved to the lower position, at least some of the fasteners being installed in an initial upper position in the threaded holes prior to unscrewing the landing sub from the tubing hanger to prevent rotation of the retainer ring as the landing sub is unscrewed.

9. A wellhead assembly, comprising in combination:

a housing which has an axial bore;

a tubing hanger which secures to a string of tubing, has an axially extending threaded bore, and which lands in the bore of the housing;

a conical cam surface formed on an upper exterior portion of the tubing hanger;

an internal profile formed in the bore of the housing in a position which aligns with the cam surface when the tubing hanger has landed in the bore of the housing;

a landing sub which releasably secures to the threaded bore of the tubing hanger for lowering the tubing hanger into the bore of the wellhead housing, the landing sub having a set of exterior upper threads;

a set of segmented dogs having exterior surfaces for engaging the profile in the housing; and a carrier ring assembly which carries the dogs and has a set of internal threads which engage the upper threads of the landing sub, supporting the carrier ring assembly on the landing sub in an upper position relative to the cam surface as the tubing hanger is lowered into the well, whereby unscrewing the landing sub from the tubing hanger while the carrier ring assembly is held against rotation moves the landing sub upward relative to the carrier ring assembly, allowing the landing sub to be subsequently lowered, which moves the carrier ring assembly and the dogs to a lower position with the dogs inserting into the profile of the housing.

10. The wellhead according to claim 9, further comprising:

a plurality of fasteners which secure to axially extending threaded holes in the tubing hanger and through holes provided in the carrier ring assembly to hold the dogs in the lower position once the carrier ring assembly has moved to the lower position 11. The wellhead according to claim 9, further comprising:

a plurality of fasteners which secure to axially extending threaded holes in the tubing hanger and through holes provided in the carrier ring assembly to hold the dogs in the lower position once the carrier ring assembly has moved to the lower position, at least some of the fasteners being installed in an initial upper position in the threaded holes prior to unscrewing the landing sub to prevent rotation of the carrier ring assembly as the landing sub is unscrewed from the tubing hanger.

12. The wellhead according to claim 9, wherein the carrier ring assembly comprises:

a carrier ring having a plurality of circumferentially spaced apart slots, each of which receives one of the dogs;

a retainer ring which contains the internal threads of the carrier ring assembly; and securing means for releasably securing the retainer ring to the carrier ring above the carrier ring.

13. The wellhead according to claim 9, wherein the carrier ring assembly comprises:

a carrier ring having a plurality of circumferentially spaced apart slots, each of which receives one of the dogs;

a retainer ring which contains the internal threads of the carrier ring assembly; and a plurality of temporary fasteners extending axially downward through the retainer ring into threaded receptacles in the carrier ring to releasably secure the retainer ring to the carrier ring; and wherein the wellhead further comprises:

a plurality of permanent fasteners which secure to axially extending threaded holes in the tubing hanger and through holes provided in the carrier ring and retainer ring to hold the dogs in the lower position once the carrier ring has moved to the lower position, at least some of the permanent fasteners being installed in an initial upper position in the threaded holes prior to unscrewing the landing sub to prevent rotation of the carrier ring assembly as the landing sub is unscrewed.

14. The wellhead assembly according to claim 9, wherein:

the profile in the wellhead has a downward and inward facing conical shoulder that intersects an axis of the bore of the housing at a selected angle;

each of the dogs has an upward and outward facing conical shoulder which mates slidingly with the conical shoulder of the profile; and the cam surface on the tubing hanger intersects the axis of the bore of the housing at an angle that differs from the angle of intersection of the conical shoulder of the profile, so as to cause the dogs to lock in the lower position.

15. A tubing hanger lockdown for use in a wellhead assembly which has a housing with an axial bore and an internal profile, a tubing hanger which secures to a string of tubing, has an axially extending threaded bore, and which lands in the bore of the housing, the lockdown comprising:

a conical cam surface formed on an upper exterior portion of the tubing hanger for aligning with the internal profile in the bore of the housing;

a plurality of threaded holes formed on an upper surface of the tubing hanger;

a landing sub which releasably secures to the threaded bore of the tubing hanger for lowering the tubing hanger into the bore of the wellhead housing, the landing sub having a set of exterior upper threads;

a set of segmented dogs having exterior surfaces for engaging the profile in the housing;

a carrier ring having a plurality of circumferentially spaced apart slots, each of which receives one of the dogs;

a retainer ring having a set of internal threads;

a plurality of temporary fasteners extending axially downward through the retainer ring into threaded receptacles in the carrier ring to releasably secure the retainer ring to the carrier ring;

the retainer ring being initially secured to the upper threads of the landing sub in an upper position, holding the dogs in a radially retracted position; and a plurality of permanent fasteners which secure to the threaded holes in the tubing hanger and through holes provided in the carrier ring and retainer ring, at least some of the permanent fasteners being installed in an initial upper position in the threaded holes;

whereby unscrewing the landing sub after the tubing hanger has landed causes the landing sub to move upward relative to the carrier ring prior to unscrewing the landing sub, with said some of the permanent fasteners preventing rotation of the carrier ring as the landing sub is unscrewed, then downward movement of the landing sub causes the carrier ring and dogs to move downward relative to the tubing hanger, causing the dogs to slide on the cam surface to an engaged position in engagement with the profile, allowing the temporary fasteners to be removed and the permanent fasteners tightened in the threaded holes of the tubing hanger to retain the dogs in the engaged position.

16. The tubing hanger lockdown according to claim 15, wherein:

the profile in the wellhead has a downward and inward facing conical shoulder that intersects an axis of the bore of the housing at a selected angle;

each of the dogs has an upward and outward facing conical shoulder which mates slidingly with the conical shoulder of the profile; and the cam surface on the tubing hanger intersects the axis of the bore of the housing at an angle that differs from the angle of intersection of the conical shoulder of the profile, so as to cause the dogs to lock in the lower position.

17. A method of locking a tubing hanger in a wellhead assembly having a housing which has an axial bore, the tubing hanger having an axially extending bore, comprising:

providing an internal profile in the bore of the housing;

providing a conical cam surface on an upper exterior portion of the tubing hanger;

securing a landing sub into the bore of the tubing hanger;

providing a set of segmented dogs, mounting the dogs to a carrier ring assembly, and securing the carrier ring assembly to the landing sub in an upper position relative to the tubing hanger;

lowering the tubing hanger into the bore of the wellhead housing with the landing sub; then moving the carrier ring assembly and the dogs to a lower position relative to the tubing hanger, causing the dogs to slide down the cam surface into the profile of the housing.

18. The method according to claim 17 wherein the step of moving the carrier ring assembly and the dogs to a lower position comprises:

moving the landing sub upward relative to the tubing hanger after the tubing hanger has landed while maintaining the carrier ring assembly and the dogs at the same axial distance from the cam surface; then moving the landing sub downward relative to the tubing hanger, causing the carrier ring assembly and the dogs to move downward with the landing sub.

19. The method according to claim 17 wherein:

the step of securing the landing sub in the bore of the tubing hanger comprises providing threads in the bore of the tubing hanger and on the landing sub and screwing the landing sub into the bore;

the step of securing the carrier ring assembly to the landing sub comprises providing a set of upper threads on the landing sub and securing the carrier ring assembly to the upper threads;

the step of moving the carrier ring and dogs to a lower position comprises:

unscrewing the landing sub from the bore of the tubing hanger after the tubing hanger has landed while preventing rotation of the carrier ring assembly and the dogs; then lowering the landing sub relative to the tubing hanger.

* * * * *